US007038179B2

(12) United States Patent
Kim et al.

(10) Patent No.: US 7,038,179 B2
(45) Date of Patent: May 2, 2006

(54) ELECTRIC OVEN AND METHOD OF CONTROLLING THE SAME

(75) Inventors: Tae-Soo Kim, Seocho-Gu (KR); Young-Won Cho, Suwon (KR); Kyung-Hee Hahm, Youngdungpo-Gu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/355,290

(22) Filed: Jan. 31, 2003

(65) Prior Publication Data

US 2004/0060927 A1 Apr. 1, 2004

(30) Foreign Application Priority Data

Sep. 26, 2002 (KR) ..... 10-2002-0058414

(51) Int. Cl.
*H05B 6/06* (2006.01)
*H05B 6/12* (2006.01)

(52) U.S. Cl. ..... 219/622; 219/624; 219/601; 219/627; 219/667; 219/400; 99/325; 99/451

(58) Field of Classification Search ..... 219/601, 219/622, 624, 626, 627, 667, 665, 400, 681, 219/685; 99/DIG. 14, 325, 451
See application file for complete search history.

(56) References Cited

U.S. PATENT DOCUMENTS

| | | | | |
|---|---|---|---|---|
| 3,790,735 | A * | 2/1974 | Peters, Jr. | 219/622 |
| 4,468,548 | A * | 8/1984 | Yamaki | 219/601 |
| 4,581,989 | A * | 4/1986 | Swartley | 99/346 |
| 4,761,529 | A * | 8/1988 | Tsisios | 219/685 |
| 5,786,568 | A * | 7/1998 | McKinney | 219/400 |
| 6,201,222 | B1 * | 3/2001 | Baker et al. | 219/497 |
| 6,388,235 | B1 | 5/2002 | Sauter et al. | |
| 2002/0117497 | A1 | 8/2002 | Bassill et al. | |

FOREIGN PATENT DOCUMENTS

| | | | | |
|---|---|---|---|---|
| JP | 6-147487 | * | 5/1994 | 219/601 |

* cited by examiner

*Primary Examiner*—Philip H. Leung
(74) *Attorney, Agent, or Firm*—Staas & Halsey LLP

(57) ABSTRACT

An electrical oven and method of controlling the same includes a heater heating unit to heat food using an electric heater; an induction heating unit to heat the food using a high-frequency current, and a control unit to drive the heater heating unit and the induction heating unit simultaneously in a preheating cooking mode. The electric oven of the present invention carries out heating by the electric heater and induction heating by high-frequency current, so preheating time required for an inner temperature of a cooking cavity to reach a preheating temperature is decreased, thereby reducing a total cooking time.

6 Claims, 4 Drawing Sheets

ELECTRIC OVEN AND METHOD OF CONTROLLING THE SAME

CROSS-REFERENCE TO RELATED APPLICATIONS

This application claims the benefit of Korean Application No. 2002-58414, filed Sep. 26, 2002, in the Korean Intellectual Property Office, the disclosure of which is incorporated herein by reference.

BACKGROUND OF THE INVENTION

1. Field of the Invention

The present invention relates to an electric oven and method of controlling the same, and more particularly, to an electric oven and method of controlling the same, which carries out general heating by an electric heater and induction heating by high-frequency current to cook food.

2. Description of the Related Art

In general, an electric oven is a cooking apparatus in which food is put in a box-shaped cooking cavity, and is cooked using heat generated by an electric heater.

Heating methods in electric ovens using electric heaters as heating sources may be classified into a natural convection heating method and a forced convection heating method.

The natural convection method is capable of cooking food by the convection of heat generated by the electric heater. In contrast, the forced convection method is capable of cooking food by blowing heat generated by a heater coil 30 embedded in a top wall of a casing 10 into a cooking cavity 20 using a blowing fan 40 disposed in a back of the casing 10, as shown in FIG. 1. Accordingly, a cooking time of an electric oven using the forced convection method is decreased in comparison with that of an electric oven using the natural convection method.

However, if the electric oven using the forced convection method carries out a cooking process, such as baking, steaming, grilling or the like, of food having a large volume and heavy weight, preheating time required for an inner temperature of the cooking cavity to reach a preheating temperature necessary to carry out the cooking is increased. Thus, a total cooking time of the electric oven using the forced convection method is increased.

SUMMARY OF THE INVENTION

Accordingly, it is an aspect of the present invention to provide an electric oven and method of controlling the same, which carries out heating by an electric heater and induction heating by high-frequency current to decrease preheating time.

Additional aspects and advantages of the invention will be set forth in part in the description which follows and, in part, will be obvious from the description, or may be learned by practice of the invention.

The foregoing and/or other aspects of the present invention are achieved by providing an electric oven including a casing to form a cooking cavity. The electric oven also includes a heater heating unit to heat food placed inside the cooking cavity using an electric heater, an induction heating unit to heat the food using a high-frequency current, and a control unit to control the heater heating unit and the induction heating unit according to a cooking mode.

The foregoing and/or other aspects of the present invention are achieved by providing a method of controlling an electric oven including receiving a cooking command, determining whether a cooking mode is a preheating cooking mode of increasing an inner temperature of a cooking cavity, and driving a heater coil and a working coil simultaneously if the cooking mode is the preheating cooking mode. The method also includes sensing the inner temperature of the cooking cavity based on the driving of the coils, and stopping the driving of the coils if the sensed inner temperature reaches a preset preheating temperature.

BRIEF DESCRIPTION OF THE DRAWINGS

The above and/or other aspects and advantages of the present invention will become apparent and more appreciated from the following detailed description of the preferred embodiments, taken in conjunction with the accompanying drawings of which.

DETAILED DESCRIPTION OF THE PREFERRED EMBODIMENTS

Figure 1:
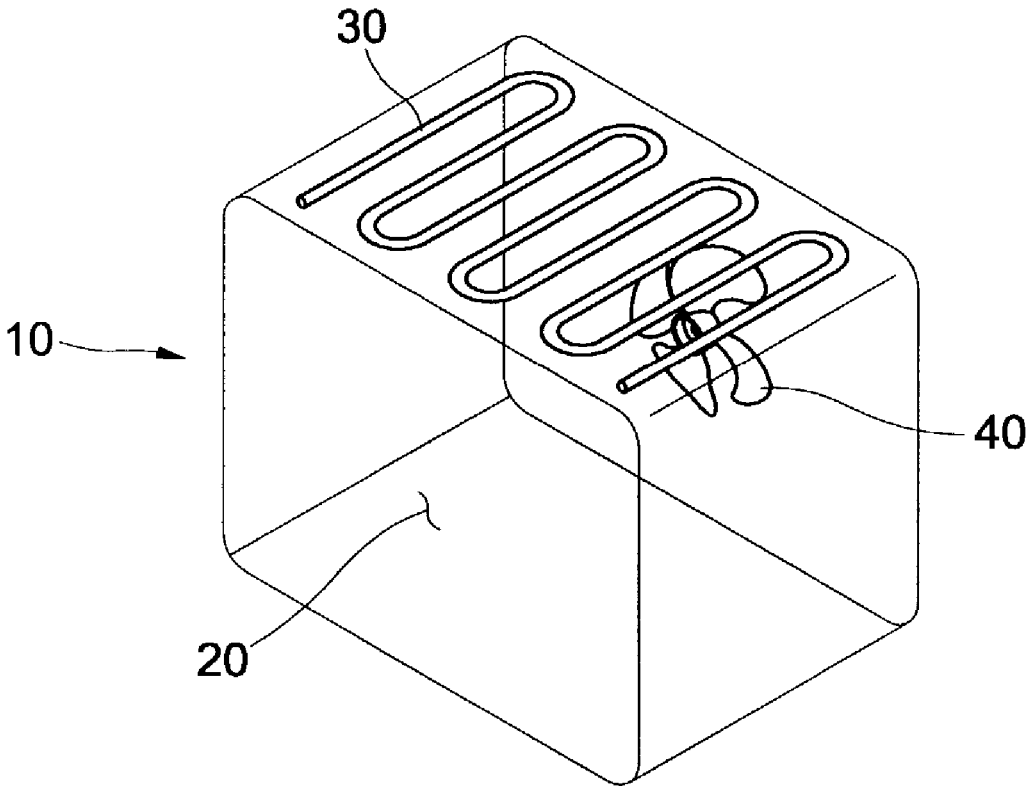
FIG. 1 (PRIOR ART)
FIG. 1 is a schematic perspective view of a conventional electric oven in which heating is carried out by an electric heater.

Reference will now be made in detail to the embodiment of the present invention, examples of which are illustrated in the accompanying drawings, wherein like reference numerals refer to like elements throughout.

Hereinafter, an electric oven and method of controlling the same of the embodiment of the present invention are described in detail with reference to the accompanying drawings.

The present invention employs both an induction heating method and a conventional forced convection method using the electric heater. The induction heating method of the present invention is used to reduce preheating time required for an inner temperature of a cooking cavity of the electric oven to reach a certain preheating temperature, which is described with reference to FIG. 2 below.

Figure 2:
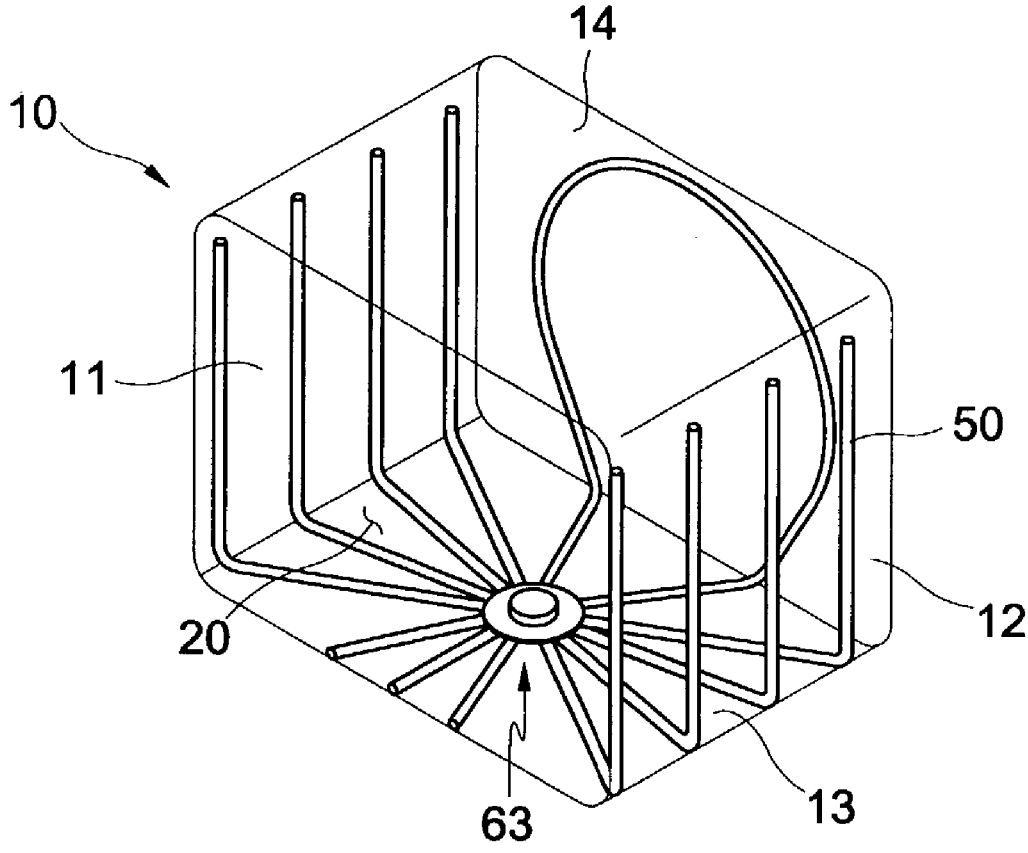
FIG. 2 is a schematic perspective view of an electric oven in which induction heating is carried out by high-frequency current, according to an embodiment of the present invention.

Referring now to FIG. 2, the electric oven of the present invention includes a working coil 50 to carry out an induction-heating of food placed in a cooking cavity 20, and a high-frequency current generation unit 63 to apply high-frequency current to the working coil 50. A casing 10 is made of an electric conductor. When the high-frequency current is applied to the working coil 50, heat is generated by a flow of eddy current caused by a magnetic field formed around the working coil 50. The high-frequency current generation unit 63 may be implemented as an inverter that supplies high-frequency current using high speed switching.

Further, the working coil 50 is embedded in side walls 11 and 12, bottom wall 13 and rear wall 14 of the casing 10, and is embedded in various places around the cooking cavity 20, except for in front of the casing 10 in which a door (not shown) is placed to selectively open or close the cooking cavity 20. The working coil 50 is also not placed in a top wall of the casing 10 in which a heater coil 30 (see FIG. 1) is embedded.

Since the casing 10 is heated by the working coil 50, heating efficiency of the working coil 50 is far superior to that of the heater coil 30. Thus, an inner temperature of the cooking cavity 20 may be quickly increased.

Figure 3:
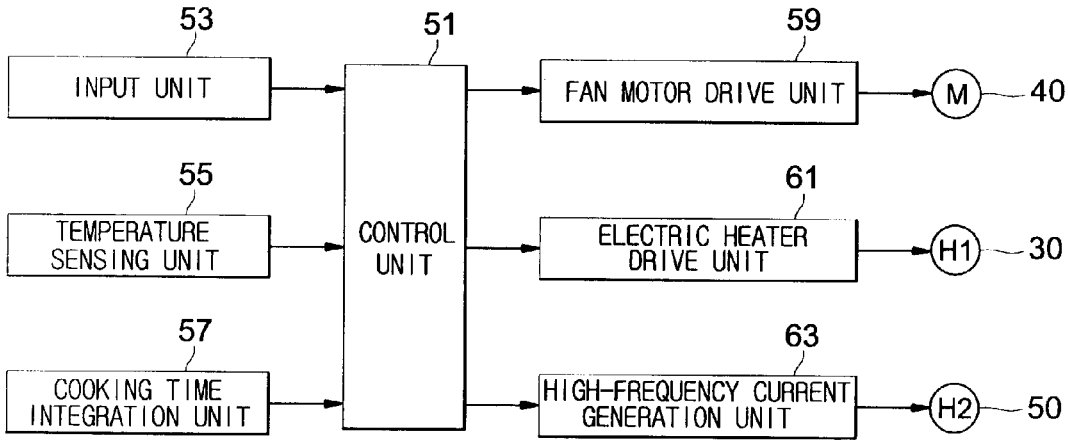
FIG. 3 is a block diagram of the electric oven of FIG. 2.

FIG. 3 is a block diagram of the electric oven of FIG. 2. The electric oven controls an overall operation relating to the cooking of food, and is equipped with a control unit 51 that may be implemented as a microcomputer. An input unit 53, a temperature sensing unit 55, and a cooking time integration unit 57 are connected at input terminals of the control unit 51. The input unit 53 is used to input cooking conditions to the control unit 51. The temperature sensing unit 55 senses the inner temperature of the cooking cavity 20, and a cooking time integration unit 57 integrates a cooking time. A fan motor drive unit 59, an electric heater drive unit 61, and a high-frequency current generation unit 63 are connected to output terminals of the control unit 51. The fan motor drive unit 59 drives the blowing fan 40 (see FIG. 1), the electric heater drive unit 61 generates heat by applying drive current to the heater coil 30, and the high-frequency current generation unit 63 applies high-frequency current to the working coil 50.

The control unit 51 receives a cooking command corresponding to the cooking conditions input by a user from the input unit 53, and determines whether the heater coil 30 and the working coil 50 will be driven according to the cooking command. That is, if the cooking command corresponding to a short preheating time is inputted to the control unit 51, the control unit 51 controls one of the heater coil 30 and the working coil 50 to be driven. In contrast, if the cooking command corresponding to a long preheating time is inputted to the control unit 51 and induction heating needs to be carried out, the control unit 51 controls the electric heater drive unit 61 and the high-frequency current generation unit 63 to drive the heater coil 30 and the working coil 50 at the same time.

A magnetic field is formed around the working coil 50 by being supplied with high-frequency current, for example, 20~30 kHz current. Therefore, induction heating is generated at positions where the working coil 50 is embedded (that is, the side walls 11 and 12, bottom wall 13 and rear wall 14 of the casing 10). Accordingly, the inner temperature of the cooking cavity 20 is increased.

In the present invention, heating by the heater coil 30 and induction heating by the working coil 50 are simultaneously carried out at the start of a cooking process, so that the inner temperature of the cooking cavity 20 may be rapidly increased. Accordingly, a preheating time required for the inner temperature at the start of the cooking process to reach a preheating temperature, previously set according to kinds of corresponding cooking, is considerably decreased.

Figure 4:
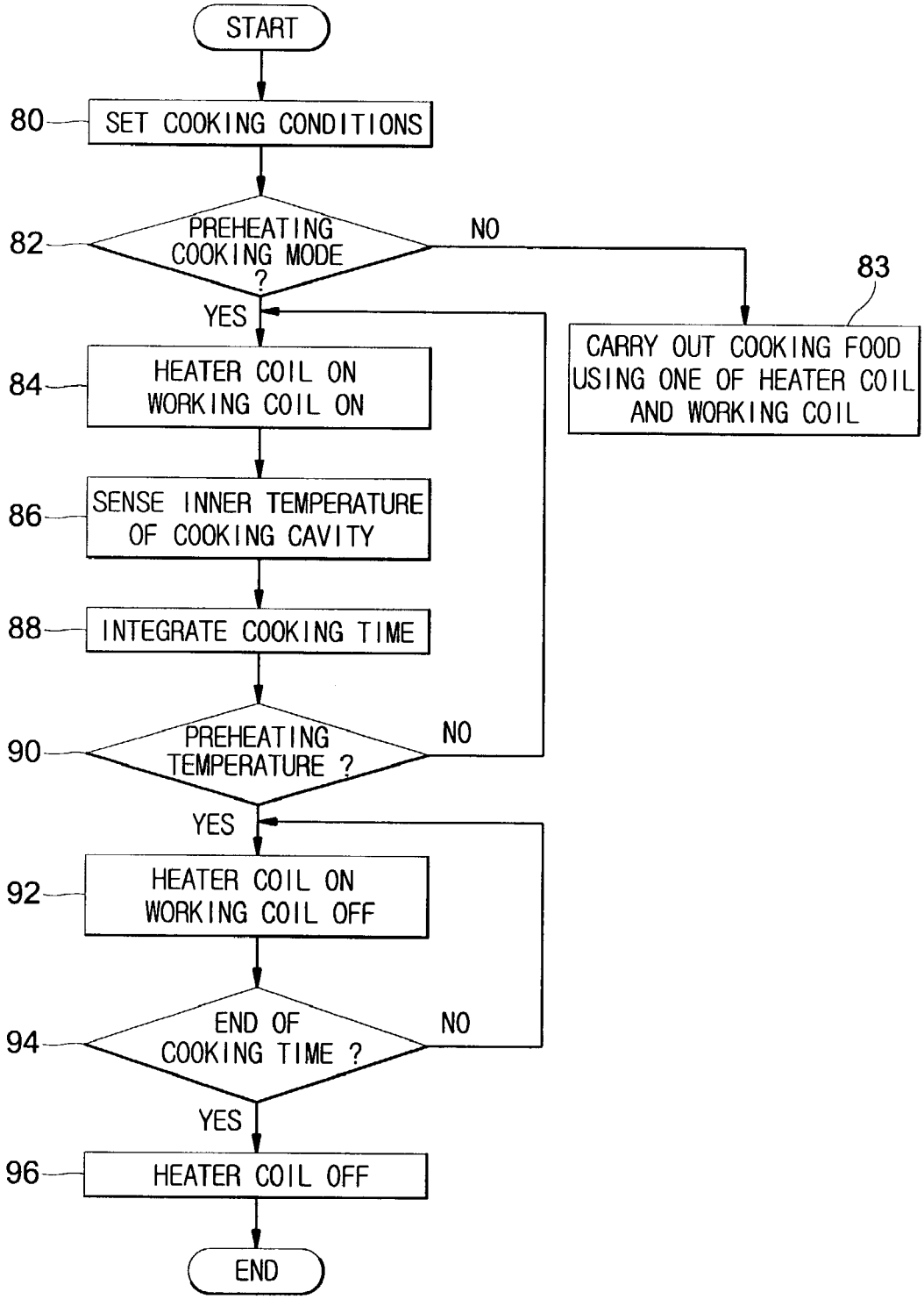
FIG. 4 is a flowchart illustrating a method of controlling the electric oven of FIG. 2.

Referring now to FIG. 4, a method of controlling the electric oven of FIG. 2 is described below.

First, the user sets desired cooking conditions through the input unit 53 after putting food in the cooking cavity 20 to be cooked and closing the door at operation 80. Thereafter, a cooking command corresponding to the set cooking conditions is inputted to the control unit 51.

The control unit 51 interprets the inputted cooking command and determines whether a preheating cooking mode preheating the electric oven by using both the heater coil 30 and the working coil 50 needs to be carried out to decrease preheating time at operation 82. As a result of the determination at operation 82, if a cooking mode is not the preheating cooking mode using both the heater coil 30 and the working coil 50, cooking is carried out using one of the heater coil 30 and the working coil 50 at operation 83.

As a result of the determination at operation 82, if the cooking mode is the preheating cooking mode using both the heater coil 30 and the working coil 50, the control unit 51 controls the electric heater drive unit 61 and the high-frequency current generation unit 63 to drive the heater coil 30 and the working coil simultaneously at operation 84.

The inner temperature of the cooking cavity 20 is rapidly increased due to heat generated by the heater coil 30 and the working coil 50. At this time, the control unit 51 senses the inner temperature of the cooking cavity 20 at operation 86. Thereafter, the cooking time integration unit 57 integrates cooking time at operation 88.

As described above, the control unit 51 determines whether the inner temperature of the cooking cavity 20 sensed by the temperature sensing unit 55 reaches a preheating temperature that corresponds to the cooking command set by the user during the preheating cooking mode at operation 90. As a result of the determination at operation 90, if the inner temperature of the cooking cavity 20 does not reach the preheating temperature, the process proceeds to operation 84 to continuously carry out the operation of the preheating cooking mode.

As a result of the determination at operation 90, if the inner temperature of the cooking cavity 20 reaches the preheating temperature, the food is heated using only the heater coil 30 so as to convert the preheating cooking mode to a normal cooking mode. Therefore, the heater coil 30 is turned on and the working coil 50 is turned off at operation 92. Since the inner temperature of the cooking cavity 20 has reached the preheating temperature by the operation in the preheating cooking mode, a preferable amount of heat needed to cook food is supplied even though only the heater coil 30 is driven in the normal cooking mode.

Thereafter, the control unit 51 determines whether the cooking time integrated by the cooking time integration unit 57 reaches the end of the cooking time set according to the cooking conditions at operation 94. As a result of the determination at operation 94, if the integrated cooking time does not reach the end of the cooking time, the process proceeds to operation 92 to continuously carry out the normal cooking mode.

As a result of the determination at operation 94, if the integrated cooking time reaches the end of the cooking time, the control unit 51 controls the electric heater drive unit 61 to turn off the heater coil 30 and terminates cooking at operation 96.

As described above, the electric oven of the present invention uses the forced convection method, in which the blowing fan 40 is driven at the same time during the driving of the electric heater and the induction heating unit, and blows hot air to the inside of the cooking cavity 20 for the purpose of reducing preheating time. Thus, the inner temperature of the cooking cavity 20 is rapidly increased.

As apparent from the above description, since the electric oven of the present invention carries out heating by the electric heater and induction heating by high-frequency current, preheating time required for the inner temperature of the cooking cavity to reach the preheating temperature is decreased, thereby reducing total cooking time.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An electric oven, comprising:

a casing to form a cooking cavity;

a heater heating unit having a heater coil embedded in the casing, to heat food placed inside the cooking cavity using an electric heater;

an induction heating unit to heat the food using a high-frequency current; and a programmable computer processor to control the heater heating unit and the induction heating unit according to a cooking mode, wherein:

the programmable computer processor drives the heater heating unit and the induction heating unit simultaneously if the cooking mode is a preheating cooking mode to increase an inner temperature of the cooking cavity;

the heater heating unit comprises an electric heater drive unit to apply drive current to the heater coil; and the induction heating unit comprises a working coil embedded in different places around the cooking cavity of the casing and a high-frequency current generation unit to apply high-frequency current to the working coil.

2. The electric oven as set forth in claim 1, wherein said casing is made of an electric conductor.

3. The electric oven as set forth in claim 1, wherein when the high-frequency current is applied to the working coil, heat is generated by a flow of eddy current caused by a magnetic field formed around the working coil.

4. The electric oven as set forth in claim 1, further comprising:

an input unit to input a cooking command;

a temperature sensing unit to sense an inner temperature of the cooking cavity;

a cooking time integration unit to integrate a cooking time; and a fan motor drive unit to drive a blowing fan provided in the cooking cavity.

5. The electric oven as set forth in claim 4, wherein the input unit, the temperature sensing unit and the cooking time integration unit are connected to an input side of the programmable computer processor, and the fan motor drive unit, an electric heater drive unit and a high-frequency current generation unit are connected to an output side of the programmable computer processor.

6. The electric oven as set forth in claim 1, wherein the programmable computer processor drives one of the heater coil and the working coil or both based on a cooking command input to the electric oven.

* * * * *

UNITED STATES PATENT AND TRADEMARK OFFICE

CERTIFICATE OF CORRECTION

PATENT NO. : 7,038,179 B2
APPLICATION NO. : 10/355290
DATED : May 2, 2006
INVENTOR(S) : Tae-Soo Kim et al.

It is certified that error appears in the above-identified patent and that said Letters Patent is hereby corrected as shown below:

On the cover page, item (54) Title, change 'ELECTRIC OVEN AND METHOD OF CONTROLLING THE SAME" to --AN INDUCTIVE HEATING ELECTRIC OVEN AND METHOD OF CONTROLLING THE SAME--

Signed and Sealed this

Nineteenth Day of September, 2006

JON W. DUDAS
*Director of the United States Patent and Trademark Office*